US006582774B2

(12) United States Patent
Klein et al.

(10) Patent No.: US 6,582,774 B2
(45) Date of Patent: Jun. 24, 2003

(54) PROCESS AND APPARATUS FOR COATING

(75) Inventors: Udo Klein, Dietzenbach (DE); Winfried Ott, Rodgau (DE); Volker Weiss, Frankfurt (DE)

(73) Assignee: Lactec GmbH Gesellschaft fuer Moderne Lackiertechnik, Rodgau (DE)

( * ) Notice: Subject to any disclaimer, the term of this patent is extended or adjusted under 35 U.S.C. 154(b) by 0 days.

(21) Appl. No.: 09/778,230

(22) Filed: Feb. 6, 2001

(65) Prior Publication Data

US 2001/0013315 A1 Aug. 16, 2001

(30) Foreign Application Priority Data

Feb. 12, 2000 (DE) ..... 100 06 310

(51) Int. Cl.[7] ..... B05D 1/02
(52) U.S. Cl. ..... 427/427; 427/421
(58) Field of Search ..... 427/421, 422, 427/424, 425, 426, 427; 118/300, 301, 302, 303, 304, 305, 313, 314, 315, 316; 236/10, 11, 13, 225.1

(56) References Cited

U.S. PATENT DOCUMENTS 4,311,724 A * 1/1982 Scharfenberger ..... 427/8
4,774,905 A * 10/1988 Nobis ..... 118/304
5,193,572 A * 3/1993 Le Devehat ..... 137/244
5,389,149 A * 2/1995 Carey et al. ..... 118/302
5,895,619 A * 4/1999 Knapp ..... 264/157
6,037,010 A * 3/2000 Kahmann et al. ..... 427/421
6,090,450 A * 7/2000 Kahmann et al. ..... 427/421
2002/0060080 A1 * 5/2002 Pliner et al. ..... 169/16

* cited by examiner

*Primary Examiner*—Shrive P. Beck
*Assistant Examiner*—Eric B Fuller

(57) ABSTRACT

A process for coating, in particular for painting, individual objects or small-series batches with a small quantity of paint uses a plurality of atomizers 2, 3, 4 connected one behind the other to a main supply line 5, at one end/start 6 of which a paint-supply unit 7 is arranged. Only the quantity of paint which is required for the painting job and an additional minimal residual quantity are introduced into the main supply line 5, irrespective of the length and the actual capacity of the main supply line 5, e.g. a paint quantity less than the volume capacity of the main supply line. The contents of the main supply line 5 are forced, by at least one pig 32, which is pushed through the line 5 by a pushing medium, to the atomizers 2, 3, 4, and the contents are then at least substantially completely discharged there.

8 Claims, 4 Drawing Sheets

PROCESS AND APPARATUS FOR COATING

FIELD OF THE INVENTION

The invention relates to a process and to an apparatus for coating, and in particular for painting, individual objects or small-series batches with a small quantity of paint with the aid of a plurality of atomizers, arranged one behind the other.

BACKGROUND INFORMATION

In order to supply different atomizers for example in a spray booth, it is known for a so-called "circular pipeline" to be laid along and/or around the booth. This circular pipeline usually begins at a paint-storage container, from which the paint material is fed into the circular pipeline with the aid of a delivery pump, and it terminates likewise at said paint-storage container, into which the pumped-round paint flows back again. The line is equipped with the fittings, necessary for proper operation, for maintaining a constant paint pressure.

Branching off from said circular pipeline to each spray point are branch lines, by means of which manual spray guns or else automatic paint atomizers may be supplied. If a multiplicity of circular pipelines for different colours are provided in parallel alongside one another, then the individual colours may be routed via a so-called "automatic colour changer", which feeds the respectively required colour to the atomizer via an individual line. The majority of these colours, which are usually processed in an installation, are so-called standard colours.

If, however, in contrast to the colour range which is supplied as standard, individual colours are to be made available for a short period of time, for example in special series, then the special colour has to be exchanged with the standard colour in one of the circular pipelines present or an individual circular pipeline solely for special colours may be supplied, in which a quick change of the colours introduced is then possible.

It is often also desired to paint merely individual workpieces, or very small quantities of workpieces, with a special colour.

For this purpose, it is known for one of the conventional circular pipelines to be filled with a special colour, there being cases in which the quantity of paint which is necessary for filling the line is larger than is necessary for actually painting the workpiece.

It is thus also known for containers for extremely small quantities to be positioned at different spray points along a spray booth, in order that the atomizers need only be supplied with short line sections. This alternative to the laborious filling of a circular pipeline for a short period of time is customary in many cases.

SUMMARY OF THE INVENTION

The object of the invention, irrespective of the basic conditions, is to specify a particularly expedient process and an apparatus for coating, and in particular for painting, individual objects or small-series batches with small quantities of paint at a plurality of atomizers arranged one behind the other, with the result that only the quantity of paint which is actually required and, in addition, a minimal, system-induced residual quantity are necessary.

In order to achieve this object, the invention provides that only the quantity of paint which is required overall and, in addition, a minimal residual quantity are introduced into the main supply line, irrespective of the length and of the actual capacity thereof, e.g. a paint quantity less than the volume capacity of the main supply line, and that the quantity of paint which is located in the main supply line is forced, with the aid of at least one pig, which is subjected to the action of a pushing medium, to the atomizer or atomizers which is/are still to be operated, and is fully, or virtually fully, discharged there.

The quantity of paint which is required is known in principle and the same applies to the capacity of the lines. Taking account of these variables, only this amount of coating medium is fed into the main supply line and either applied to the workpiece or workpieces at one or more atomizers or is only applied when the pig and the pushing medium moving it are already located in the main supply line, It is thus possible for the coating medium introduced to be used up completely without considerable residual quantities having to be discarded and disposed of.

The atomizers are usually located at the free end of branch lines, the other end of which is arranged on a colour changer, through which the main supply line is guided.

In order for the contents of said branch lines likewise to be fully utilized, a development of the invention provides that, even prior to completion of the coating, the contents of the branch line are emptied under pressure likewise with the aid of a pig in the direction of the atomizer or, following completion of the coating, are emptied under pressure in the direction of the colour changer and main supply line.

In order to carry out the process, metering and/or control and/or measuring devices are provided to a sufficient extent, these measuring the essential parameters of the volume flow at the respectively relevant points and controlling the apparatus.

BRIEF DESCRIPTION OF THE DRAWINGS

The invention is described in more detail hereinbelow with reference to exemplary embodiments, which are illustrated in the drawing, in which.

DETAILED DESCRIPTION OF THE INVENTION

Figure 1:
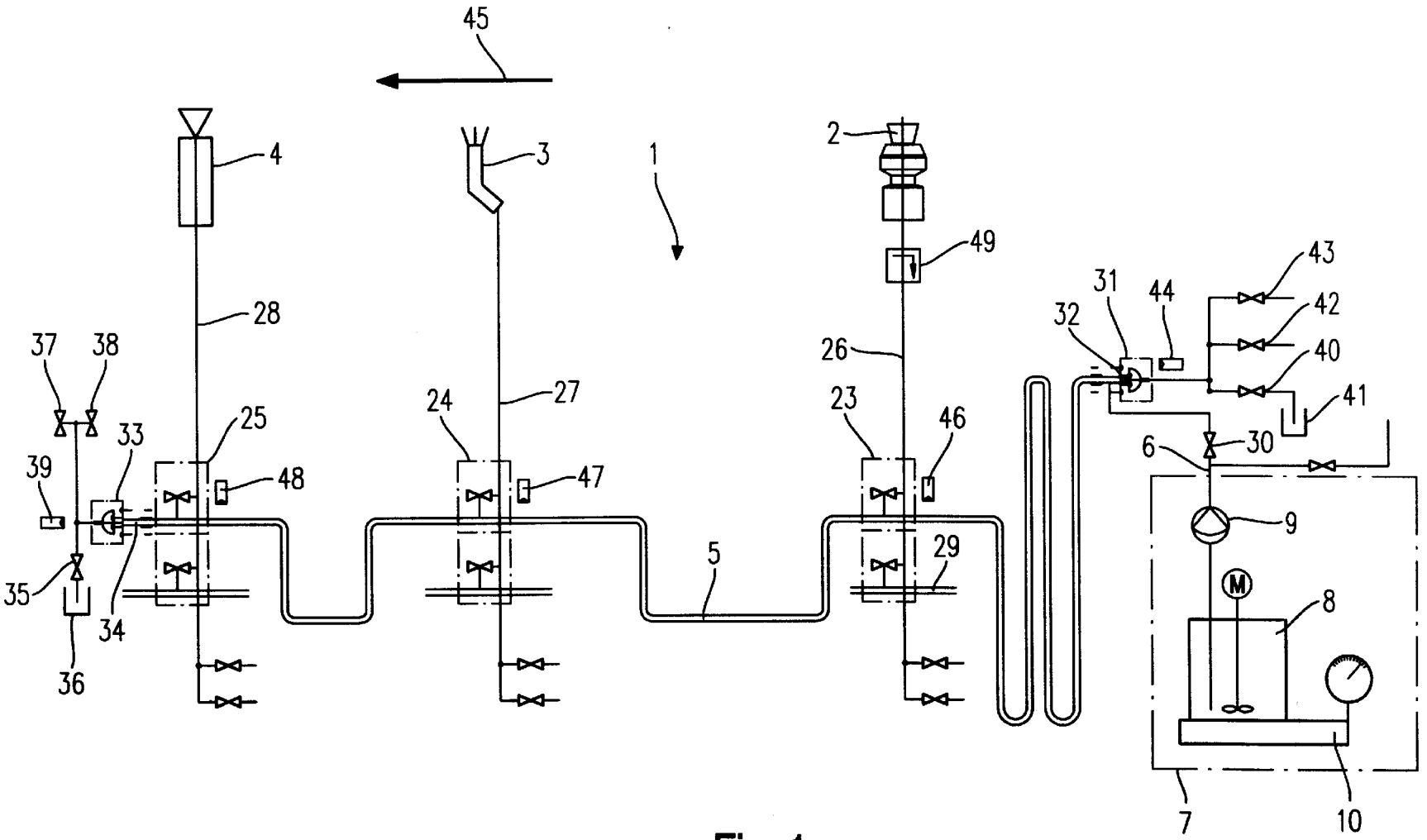
FIG. 1 shows a flow diagram of the apparatus.

An apparatus 1 for coating or painting individual objects for small-series batches with a small quantity of paint at a plurality of atomizers 2, 3, and 4 arranged one behind the other comprises a main supply line 5 and a paint-supply unit 7 arranged at one end 6 of said main supply line. The paint-supply unit 7 is arranged in a central location, for example outside a spray booth, and comprises, if appropriate, a mobile, displaceable accommodating structure (transporting carriage) for a paint-storage container 8. The paint-supply unit 7 contains, according to the exemplary embodiment illustrated in FIG. 1, a paint-delivery pump 9 and a quantity-measuring device 10. FIG. 1 illustrates the quantity-measuring device 10 as weighing scales which transmit the quantity contained in the paint-supply container 8 via a signal line, to a control means which belongs to the apparatus 1 but is of no particular interest here.

Figure 6:
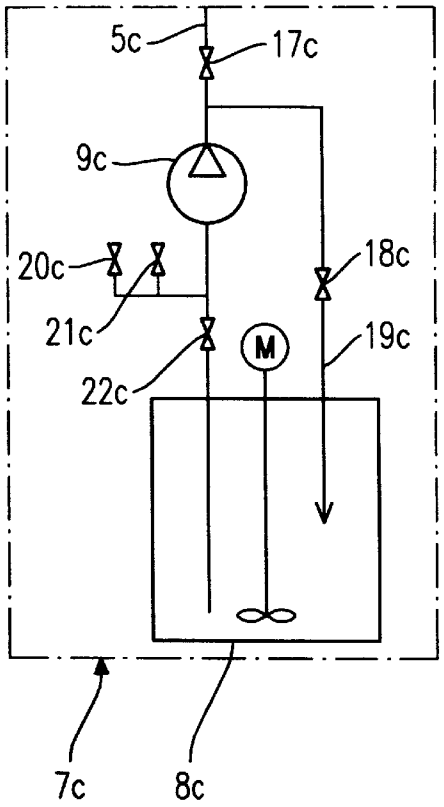
FIG. 6 shows a further exemplary embodiment of a paint-supply unit.
Figure 5:
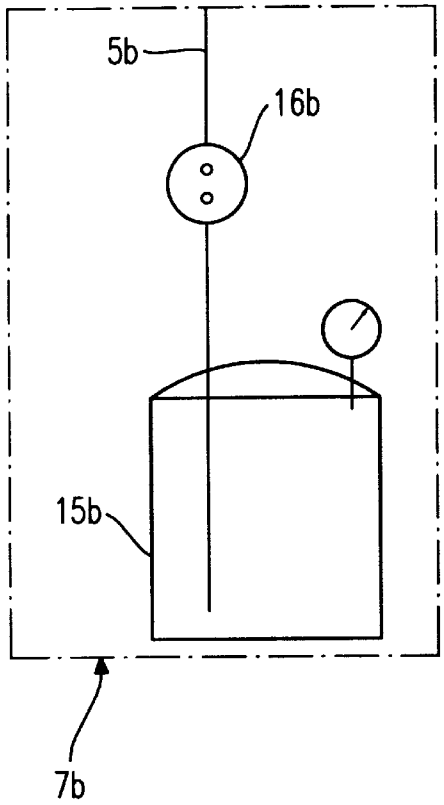
FIG. 5 shows a modified paint-supply unit.
Figure 4:
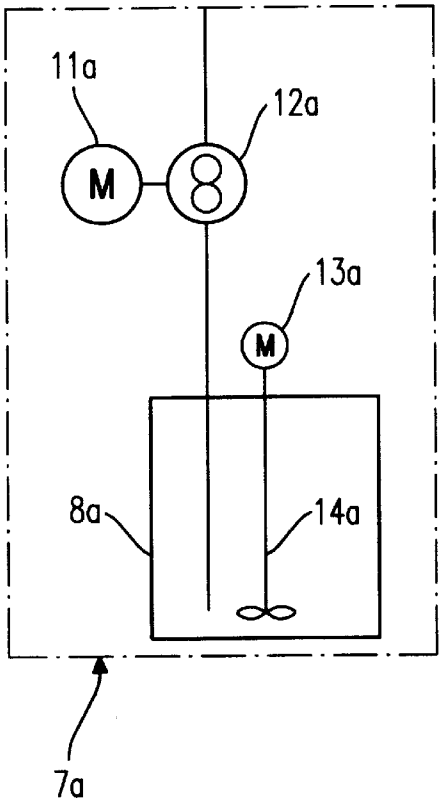
FIG. 4 shows, on an enlarged scale, a paint-supply unit.

Embodiments of the paint-supply unit 7 are illustrated in FIGS. 4 to 6, the same parts basically having the same designation numbers and additional letter suffixes.

The paint-supply unit 7*a* according to FIG. 4 comprises a paint-supply container 8*a* from which the paint material is delivered with the aid of a volumetrically operating pump 12*a*, for example a gear pump, driven by an electric motor 11*a*. The rotational speed of the motor and the quantity of paint delivered by the pump 12*a* are communicated to the primary control means. A stirring unit 14*a* driven by a motor 13*a* keeps the paint located in the Paint-supply container 8*a* moving.

The paint-supply unit 7*b* according to FIG. 5 comprises a pressure vessel 15*b* from which the paint is forced into the main supply line 5*b* by being subjected to a positive pressure. Integrated in the main supply line 5*b* is a measuring cell 16*b*, for example a gear-type measuring cell or an induction measuring device, by means of which the quantity of paint introduced into the main supply line 5*b* is detected.

A further paint-supply unit 7*c* comprises, according to FIG. 6, the paint-storage container 8*c*, from which the paint material is delivered into the main supply line 5*c* by a paint-delivery pump 9*c*. Furthermore, FIG. 6 shows a release valve 17*c*, which releases the flow of paint in the direction of the main supply line 5*c*, and a release valve 18*c*, which releases the flow of paint into a return line 19*c* into the paint-storage container 8*c*. Also provided are a flushing-agent valve 20*c*, by means of which flushing agent can be moved to the intake side of the paint-delivery pump 9*c* in order to flush the paint-delivery pump 9*c* and/or the return line 19*c* into the paint-storage container 8*c*, and a flushing-air valve 21*c*, by means of which the flushing agent can be forced out of the paint-delivery pump 9*c* and/or out of the flushed lines. A release valve 22*c*, completes the paint-supply unit 7*c* and releases the flow of the flushing agent and/or of the flushing air either through the paint-delivery pump 9*c* or through the intake line into the paint-storage container 8*c*.

According to FIG. 1, the main supply line 5 may be of any desired length and leads to one or more colour changers 23, 24 and 25 which are arranged along the spray booth and from which in each case at least one branch line 26, 27 and 28, respectively, leads to the removal or spray points, these being the atomizers 2, 3 and 4, respectively.

The main supply line 5 is piggable and is preferably a branch line. It leads to at least one removal point or atomizer, but usually to more than one removal point or atomizers 2, 3, 4 arranged one behind the other. It is also possible for two or more such main supply lines (5*a*–*x*) to be guided in parallel to various removal points/atomizers, which are located, for example, on opposite sides of a spray booth.

Further paint-feeding lines 29, which may also be circular pipelines, may be guided through the colour changers 23, 24 and 25.

Each main supply line 5 has, at its start or at one, delivery-pump end 6, a release valve 30, this being followed by a first parking station 31 for a pig 32, and terminates, preferably downstream of the last removal point, with a second parking station 33, in which the pig 32 can allow the fluid which flows past it during operation to pass. The parking station 33, which is arranged at the second end 34, is adjoined by a valve combination which comprises at least one valve 35 for release into a collecting line and/or into a collecting container 36 as well as a valve 37 for flushing agent and a valve 38 for a pushing medium, preferably compressed air.

In order to detect the incoming paint column, a sensor 39, preferably a pressure sensor, may be arranged on the parking station 33.

Basically the same type of components as those assigned to the second parking station 33 are also assigned to the first parking station 31, and comprise a valve 40 for release into a collecting line and/or into a collecting container 41, a valve 42 for flushing agent and a valve 43 for a pushing medium, preferably compressed air. A sensor 44 for detecting the incoming pig 32 in the parking station 31 is likewise provided.

The feed of paint to the individual removal points or atomizers for painting individual workpieces or small-series batches takes place such that, once the paint-storage container 8 has been connected to the paint-delivery pump 9 and/or to the main supply line 5, first of all the release valve 30 is opened, with the result that the paint flows to the valve 35 arranged at the end of said main supply line. As the main supply line 5 is filled, the valve 35, which is arranged downstream of the second parking station 33, is opened.

Once the release valve 30 has been opened, only the quantity of paint which is necessary for painting the individual workpiece or the small-series batch is introduced into the main supply line 5. Added to this is a certain, unavoidable additional quantity in order to compensate for filling losses. The filling quantity is metered via the quantity-measuring device 10 and/or via a control means which controls the release valve 30, and the valve 35 at the other end of the main supply line 5, in dependence on the signals from the quantity-measuring device 10 and by means of preprogrammed requirement data.

Accordingly, the colour changers 23 to 25, from which the branch lines 26 to 28 lead to the removal or spray points/atomizers 2 to 4, are operable.

A further precondition here is that the conveying direction of the workpiece which is to be painted runs in the direction of the arrow 45, that is to say in the direction in which the paint flows in the main supply line 5.

Arranged upstream of each colour changer 23, 24, 25 is a sensor 46, 47, 48, respectively, which detects the pig 32 moving downstream of the paint column introduced. By means of the signal, it is possible to ensure that the colour valve assigned to the colour changer closes before the pig 32 passes the respective colour changer.

In dependence on the quantity of paint which is to be applied at the respective atomizers 2 to 4, it is also possible for one or other of the branch lines 26 to 28 already to be filled wholly or partially together with the main supply line 5. The task of metering the quantity of paint for the respective atomizer 2 to 4 is assumed by a metering unit 49 which is arranged in each case between the colour changer 46 to 48 and the atomizer 2 to 4. Said metering unit may be a remote-controlled paint-pressure regulator, a gear-type metering pump or some other adjusting element. It also goes without saying that metering units 49 are arranged in all branch lines, and that control and/or measuring devices which measure and control the volume flow at the respectively relevant points are provided, without this being illustrated specifically in the figures.

The paint introduced into the main supply line 5 is applied at the atomizer or atomizers 2, 3, 4 during the operation of the pig and used up completely, or virtually completely in this case. If the branch lines 26 to 28 are relatively short, the residue located there is discarded at a later stage.

Figure 2:
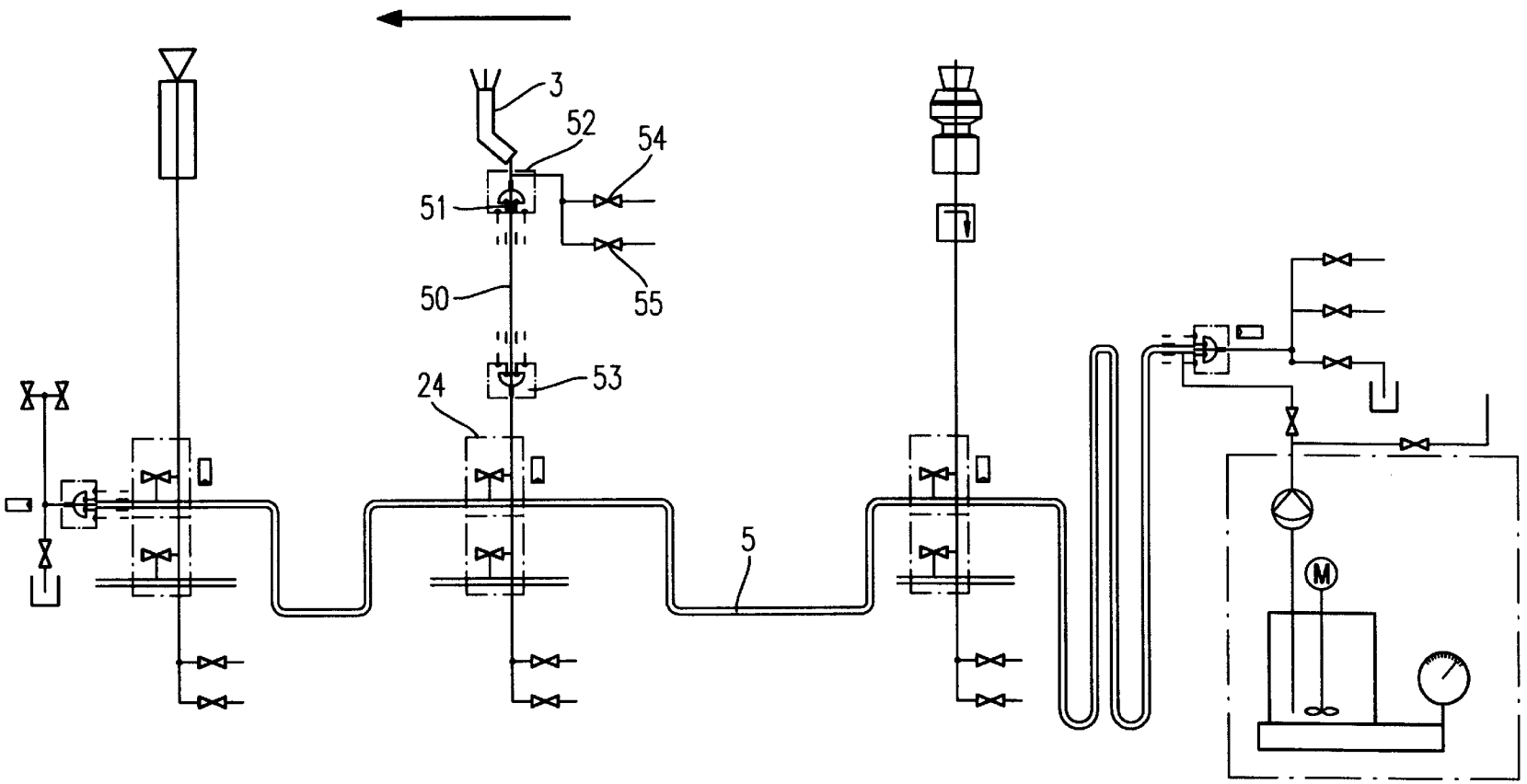
FIG. 2 shows a flow diagram of the modified embodiment.

If one or more branch lines 50 are relatively long, as in the case of the exemplary embodiment illustrated in FIG. 2, then the paint residues contained therein can be forced back into the main supply line 5 following termination of the painting operation. This takes place with the aid of a further pig 51, for which the branch line 50 has parking stations 52 and 53 as well as the associated valves 54 and 55 for a pushing medium and for flushing agent, respectively.

According to the case illustrated in FIG. 2, the paint column located in the branch line 50 can be forced back into the main supply line 5, with the aid of the pig 51, following termination of the painting at the atomizer 3, with the result that the paint can then be forced into another branch line whose atomizer requires additional paint.

It is also possible, in principle, to fill one branch line after the other and to empty the same in the reverse direction again if the corresponding branch lines, in addition to the main supply line 5, are each equipped with dedicated parking stations and a dedicated pig, such that the paint column located in the branch line is forced back to the main supply line 5 by the pig.

If, in the exemplary embodiment illustrated in FIG. 2, the pig 51 parks in the parking station 53, which is located in the vicinity of the colour changer 24, rather than in the atomizer-side parking station 52 during the painting operation, and if said parking station 53 is connected to at least one pushing medium via a valve (not illustrated), it is also possible for the contents of the branch line 50 additionally to be used up via the atomizer 3.

On account of the process described, the quantity of paint introduced into the main supply line 5 only has to correspond to the actual net requirements and to exceed this requirement merely by an extremely small quantity of paint which, as a result of circuit-induced line losses, cannot be avoided. Irrespective of this, immediately following completion of the painting of the individual workpiece or of the small-series batch at the last atomizer, no residues which have to be disposed of are left behind. The quantity of paint introduced initially into the main supply line 5 has been used up completely.

With the aid of the two valve combinations upstream of the pig-parking station 31 and downstream of the pig-parking station 33, it is then possible for the main supply line 5 to be flushed optionally in both directions.

Figure 3:
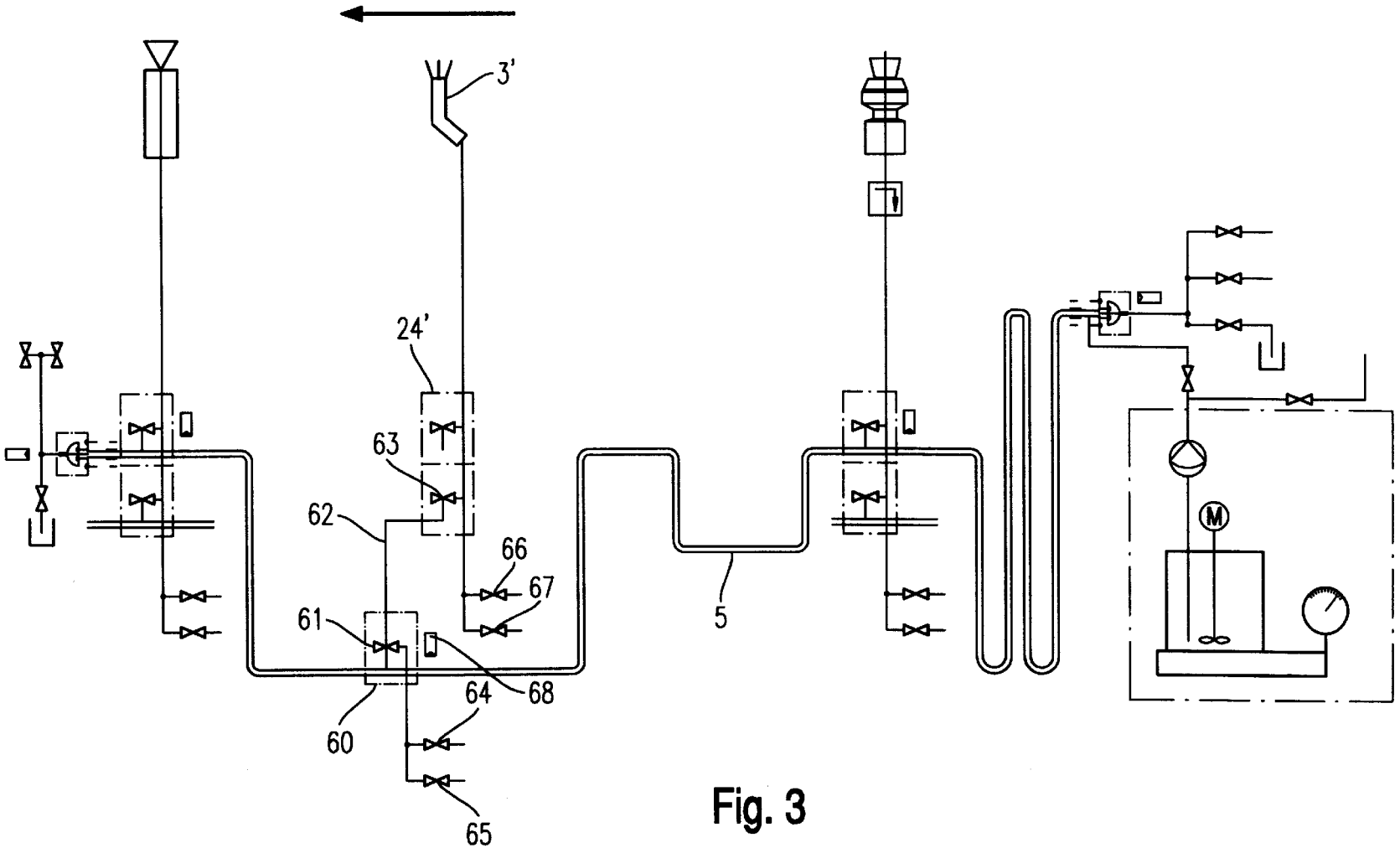
FIG. 3 shows a flow diagram of a third exemplary embodiment.

According to the exemplary embodiment illustrated in FIG. 3, the main supply line 5, for supplying an atomizer 3', is not guided directly through the colour changer 24' thereof, or connected directly to one of the valves thereof, but rather is guided through a separately arranged colour-changer unit 60. The main supply line 5 is connected to one of the valves 63 of the colour changer 24' via the valve 61 located there and a separate line 62.

Furthermore, the valve 61 is connected, via a line, to a valve 64 for a pushing medium and to a valve 65 for a flushing agent. Corresponding valves 66 and 67 for a pushing medium and for flushing agents are connected to all the colour changers 23 to 25 and 24', etc.

It is also the case that a sensor 68 is assigned to the colour-changer unit 60, as is also the case for the other colour changers.

The pig-parking stations 31, 33 and 52, 53 respectively serve for parking and for intercepting the pig 32 and the pig 51.

What is claimed is:

1. A method of coating one or more workpieces in a coating job batch with a particular coating material, using a coating system including a coating material supply unit that supplies said coating material, a main supply line that has an inlet end connected to said coating material supply unit and that extends away from said coating material supply unit, plural coating material atomizers respectively connected to said main supply line by respective branch connections successively spaced from one another along said main supply line, and a pig arranged and dimensioned to be movable in and along said main supply line;

said method comprising the steps:

a) determining a required quantity of said coating material that will be required for coating said one or more workpieces;

b) determining a residual quantity of said coating material that will remain residually in at least one of said atomizers and said branch connections;

c) determining a total quantity of said coating material as a sum of said required quantity and said residual quantity, wherein said total quantity is independent of a volume capacity of said main supply line;

d) metering and supplying only said total quantity of said coating material from said coating material supply unit through said inlet end into said main supply line;

e) at a completion of said step d), positioning said pig in said main supply line at a tail end of said total quantity of said coating material in said main supply line; and f) opening one or more of said branch connections to enable flow communication therethrough to one or more of said atomizers respectively connected thereto, and pushing said pig with a pushing medium through said main supply line in a direction from said inlet end toward said branch connections, whereby said pig pushes said coating material in said main supply line thereby pushing and atomizing said required quantity of said coating material out through said one or more of said atomizers, whereas said residual quantity of said coating material remains residually in at least one of said one or more branch connections and said one or more atomizers.

2. The method according to claim 1, wherein said total quantity of said coating material is less than said volume capacity of said main supply line.

3. The method according to claim 1, wherein said pushing and atomizing of said required quantity of said coating material out through said one or more of said atomizers is begun, carried out and completed entirely during said pushing of said pig by said pushing medium, so that all of said pushing and atomizing of said required quantity of said coating material is effectuated by said pushing medium.

4. The method according to claim 1, wherein said step f) only commences after said step e) has been completed.

5. The method according to claim 1, wherein none of said total quantity of said coating material is returned to said coating material supply unit at any time.

6. The method according to claim 1, wherein said metering of said total quantity of said coating material is carried out in said coating material supply unit.

7. The method according to claim 1, wherein each one of said branch connections respectively comprises a respective branch line connected to a respective one of said atomizers, a respective color changer connected to and interposed between said respective branch line and said main supply line, and a respective auxiliary pig arranged and dimensioned to be movable in and along said respective branch line, and wherein said method further comprises, following completion of said step f), pushing said respective pig through said respective branch line in a direction from said respective atomizer to said respective color changer to empty a content of said coating material out of said respective branch line.

8. The method according to claim 1, wherein each one of said branch connections respectively comprises a respective branch line connected to a respective one of said atomizers, a respective color changer connected to and interposed between said respective branch line and said main supply line, and a respective auxiliary pig arranged and dimensioned to be movable in and along said respective branch line, and wherein said method further comprises, prior to completion of said step f), pushing said respective pig through said respective branch line in a direction from said respective color changer to said respective atomizer to push and atomize a content of said coating material out of said respective branch line through said respective atomizer as a portion of said required quantity of said coating material.

* * * * *

UNITED STATES PATENT AND TRADEMARK OFFICE

CERTIFICATE OF CORRECTION

PATENT NO. : 6,582,774 B2
DATED : June 24, 2003
INVENTOR(S) : Klein et al.

It is certified that error appears in the above-identified patent and that said Letters Patent is hereby corrected as shown below:

Title page,
Insert: -- Item [74], *Attorney, Agent, or Firm* - W. F. Fasse; W. G. Fasse --

Column 3,
Line 13, after "the" (second occurrence) replace "Paint-supply", by -- paint-supply --.

Signed and Sealed this

Twenty-first Day of October, 2003

JAMES E. ROGAN
*Director of the United States Patent and Trademark Office*